US009695613B2

(12) United States Patent
Shepherd

(10) Patent No.: US 9,695,613 B2
(45) Date of Patent: Jul. 4, 2017

(54) WIRE-MESH SECURITY FENCES, METHODS AND SYSTEMS AND FENCE PANELS

(71) Applicant: C. E. Shepherd Company, L.P., Houston, TX (US)

(72) Inventor: G. Maury Shepherd, Houston, TX (US)

(73) Assignee: C. E. Shepherd Company, L.P., Houston, TX (US)

( * ) Notice: Subject to any disclaimer, the term of this patent is extended or adjusted under 35 U.S.C. 154(b) by 13 days.

(21) Appl. No.: 14/742,338

(22) Filed: Jun. 17, 2015

(65) Prior Publication Data

US 2015/0337558 A1 Nov. 26, 2015

Related U.S. Application Data

(63) Continuation-in-part of application No. 14/462,294, filed on Aug. 18, 2014, which is a (Continued)

(51) Int. Cl.
*E04F 17/02* (2006.01)
*E04H 17/16* (2006.01)

(Continued)

(52) U.S. Cl.
CPC ..... *E04H 17/161* (2013.01); *E04H 17/02* (2013.01); *E04H 17/20* (2013.01); *E04H 17/24* (2013.01)

(58) Field of Classification Search
CPC ..... E04H 17/16; E04H 17/161; E04H 17/163; E04H 17/02; E04H 17/04; E04H 17/06; E04H 17/12; E04H 17/24
See application file for complete search history.

(56) References Cited

U.S. PATENT DOCUMENTS 1,019,071 A 3/1912 Miller
1,284,569 A 11/1918 Bikowski (Continued)

FOREIGN PATENT DOCUMENTS

DE 2719343 A1 * 11/1978 ..... B21F 27/10
JP 2007189994 A * 8/2007
JP 2009254294 A * 11/2009

OTHER PUBLICATIONS

File history of co-related U.S. Appl. No. 12/881,810, filed Sep. 14, 2010, 63 pages.

(Continued)

*Primary Examiner* — Jonathan Masinick
(74) *Attorney, Agent, or Firm* — Gordon Arnold; Arnold, Knobloch & Saunders, L.L.P.

(57) ABSTRACT

A game fence roll having a panel and skirt is provided along with a process for installation of a fence using the roll. A wire-mesh security fence panel and security fence is provided. In at least on example the fence panel includes: a first set of substantially parallel wires, each wire having a first and a second end; a second set of substantially parallel wires, the second set of wires being welded across the first set on one picket-wire side of the first set; a cross-wire-side connection strip welded across the first end of the first set on the picket-wire side of the first set; and an opposite side connection strip welded across the second end of the first set on the opposite side of the picket-wire side. In one such example each connection strip has an outside edge and each outside edge is equally spaced from the end of the wires to which the strip is welded.

20 Claims, 14 Drawing Sheets

Related U.S. Application Data continuation-in-part of application No. 14/204,318, filed on Mar. 11, 2014, now abandoned, which is a continuation of application No. 13/958,128, filed on Aug. 2, 2013, now abandoned, which is a continuation of application No. 13/683,780, filed on Nov. 21, 2012, now abandoned, which is a continuation of application No. 12/881,810, filed on Sep. 14, 2010, now abandoned.

(60) Provisional application No. 62/013,184, filed on Jun. 17, 2014, provisional application No. 61/242,239, filed on Sep. 14, 2009.

(51) Int. Cl.

| | |
|---|---|
| ***E04H 17/02*** | (2006.01) |
| ***E04H 17/20*** | (2006.01) |
| ***E04H 17/24*** | (2006.01) |

(56) References Cited

U.S. PATENT DOCUMENTS

| | | | | |
|---|---|---|---|---|
| 2,516,807 | A | 7/1950 | Schulte | |
| 3,080,022 | A | 3/1963 | Mote | |
| 3,604,686 | A | 9/1971 | Parisien | |
| 4,098,493 | A | 7/1978 | Logan | |
| 4,380,327 | A | 4/1983 | Fish | |
| 4,393,987 | A * | 7/1983 | Anderson | B21D 26/055 228/157 |
| 4,558,851 | A | 12/1985 | Nakayama | |
| 5,052,846 | A | 10/1991 | Behshid | |
| 5,379,564 | A | 1/1995 | Wynne | |
| 5,421,557 | A | 6/1995 | Vise | |
| 5,542,649 | A | 8/1996 | Allegaert et al. | |
| 5,556,080 | A | 9/1996 | Vise | |
| 5,623,791 | A * | 4/1997 | Schwarz | E06B 9/01 248/74.1 |
| 6,010,116 | A | 1/2000 | Knott, Sr. | |
| 6,151,852 | A | 11/2000 | Linn et al. | |
| 6,152,428 | A * | 11/2000 | Simioni | E04H 17/166 256/19 |
| 6,409,031 | B1 | 6/2002 | Wynne | |
| 6,491,474 | B1 | 12/2002 | Maxwell | |
| 6,637,728 | B2 | 10/2003 | Pettit et al. | |
| 7,152,535 | B2 | 12/2006 | Mikich et al. | |
| 7,234,283 | B2 * | 6/2007 | Russo | E01F 7/045 256/12.5 |
| 7,461,489 | B2 | 12/2008 | Herbertsson | |
| 7,516,946 | B2 | 4/2009 | Fumagalli | |
| 7,740,233 | B1 | 6/2010 | Larsen | |
| 7,866,635 | B2 | 1/2011 | Payne | |
| 2002/0027225 | A1 | 3/2002 | Saura Sotillos et al. | |
| 2003/0209701 | A1 | 11/2003 | Goddard | |
| 2006/0038165 | A1 * | 2/2006 | Larsen | B21F 27/005 256/32 |
| 2006/0226406 | A1 | 10/2006 | Vise et al. | |
| 2006/0237704 | A1 | 10/2006 | Rodenburg | |
| 2007/0252125 | A1 | 11/2007 | Thompson | |
| 2007/0261333 | A1 | 11/2007 | Behshid | |
| 2008/0006808 | A1 | 1/2008 | Thompson | |
| 2008/0157045 | A1 | 7/2008 | Park et al. | |
| 2008/0173856 | A1 | 7/2008 | Payne | |
| 2008/0185565 | A1 | 8/2008 | Major et al. | |
| 2008/0277638 | A1 * | 11/2008 | Benner | A01K 3/00 256/11 |
| 2009/0314220 | A1 | 12/2009 | Groh et al. | |
| 2010/0078613 | A1 | 4/2010 | Payne | |
| 2010/0295007 | A1 | 11/2010 | Preston | |
| 2011/0062404 | A1 | 3/2011 | Shepherd | |
| 2013/0082226 | A1 | 4/2013 | Shepherd | |
| 2013/0313500 | A1 | 11/2013 | Shepherd | |
| 2014/0191176 | A1 | 7/2014 | Shepherd | |
| 2014/0353564 | A1 | 12/2014 | Shepherd | |

OTHER PUBLICATIONS

File history of co-related U.S. Appl. No. 13/683,780, filed Nov. 21, 2012, 67 pages.

File history of co-related U.S. Appl. No. 13/958,128, filed Aug. 2, 2013, 82 pages.

File history of co-related U.S. Appl. No. 14/204,318, filed Mar. 11, 2014, 78 pages.

File history of co-related U.S. Appl. No. 14/462,294, filed Aug. 18, 2014, 82 pages.

File history of co-related U.S. Appl. No. 62/013,184, filed Jun. 17, 2014, 34 pages.

File history of co-related PCT Application No. PCT/US15/36262, filed Jun. 17, 2015, 72 pages.

* cited by examiner

WIRE-MESH SECURITY FENCES, METHODS AND SYSTEMS AND FENCE PANELS

RELATED APPLICATIONS

This application claims priority to U.S. Provisional Application No. 62/013,184, filed Jun. 17, 2014, and this application is a continuation-in-part application of Ser. No. 14/462,294, filed Aug. 18, 2014, which is a continuation-in-part of Ser. No. 14/204,318, filed Mar. 11, 2014, which is a continuation of U.S. patent application Ser. No. 13/958,128, filed on Aug. 2, 2013, which is also a continuation of Ser. No. 13/683,780, filed on Nov. 21, 2012, which is also a continuation of Ser. No. 12/881,810, filed Sep. 14, 2010, which claims priority to U.S. Provisional Application No. 61/242,239 filed Sep. 14, 2009, all of which are incorporated herein by reference for all purposes.

BACKGROUND OF THE INVENTION

In the field of security fences, "cut resistance" and "climb resistance" has led to the use of welded mesh fence. Such fences are made by arranging multiple horizontal lines of wire—spaced apart a small distance—and welding vertical cross wires to the horizontal lines. The result is a mesh. Typical mesh used in security fences is so called "3-5-8" (meaning that the horizontal lines are about 3 inches apart, the cross wires are 0.5 inches, and the wire is 8 gauge). Other dimensions and mesh patterns are known or will occur to those of skill in the art. The wires are welded into a mesh on a variety of welding systems (for example, automatic resistance-mesh welders, such as those available from Entwicklungs- and Verwertungs-Gesellschaft m.b.H. (a.k.a. "EVG") and Clifford/Ideal Welding Systems). Continuous wire welders and jig welders are used to perform the welding. To prevent the panels from warping, tension is placed on the wires during the welding process. The ends of the panels are typically finished with a cross wire welded across the face of the horizontal like wires.

In practice, welded mesh fences present problems. For example, in a typical installation, the fence posts are installed about 8 feet apart, but the spacing may be very irregular. Likewise, in some applications, a welded mesh fence may need to be installed on pre-existing chain link posts. Since chain link does not require highly regular spacing, it can be stretched to accommodate significant irregularities. In welded mesh fencing, however, stretching the width of the panel is not possible Further, the hardware typically used to join panels leaves nuts or other parts that are vulnerable to attack on the outside of the fence, reducing the security of the fence.

Therefore, there is a need for a wire-mesh fence and a wire-mesh fence panels that gives flexibility in installation with irregularly-spaced posts. There is a separate need for reducing the amount of connection component material that is easily attacked on the outside of the fence.

Tall fencing for wild game ranching and control applications has been available for many years. These fences are required to be taller than typical livestock fence because of the ability many wild animals such as white tail deer, antelope, impala and other similar species, have to jump over the common stock fencing. This taller fencing is regularly referred to in the trade as "Game Fence" or "High Fence."

There are various types of wire mesh used to manufacture high fence. They include various types of twisted hexagonal mesh fabric similar to chicken wire, woven rectangular mesh commonly referred to as chain link and several types of knotted mesh, some of which use a third wire wrapped around the two wires of the intersecting horizontal and vertical mesh wires, or wrap one of the vertical wires around the horizontal wires to hold the intersection together. Welded wire mesh is also used.

All game fence mesh must be able to closely follow irregular terrain while remaining tight and flat against the fence posts. This is generally accomplished in welded and knotted mesh fence by creating a bend in the straight, horizontal wires of the fence between the intersections with the vertical wire such that when tension is applied to the fence to flatten it against the fence post during installation the bend in the horizontal wire will be forced to become straight and the fence will elongate more than would be possible with only a straight horizontal wire. The bend in the horizontal wire also allows the fence to bend within its plane to accommodate irregularities in the terrain and to recoil when hit by running animals without permanent deformation of the fence. The number of horizontal wires, their breaking strength, the wire diameter and the shape of the bend will all affect the stretching and resiliency of the mesh.

Some game fences that are manufactured entirely from hexagonal twisted mesh can be bent 90 degrees at the bottom to form an apron but this process is time consuming and results in an irregular shaped apron that is difficult to properly anchor and thus is less effective. This secondary operation to install an apron is, in either case, time consuming and relatively expensive. Installing a game fence without an apron wire significantly reduces its effectiveness and devalues the investment in the fence by greatly increasing the possibility that expensive stock will escape or fall prey to predators that can quickly dig under an unsecured, even burred game fence. Further, conventional apron mesh does little to reinforce the lower edge of the game fence. Excited animals naturally try escape by attempting to push their nose under the fence along the bottom.

While extended post spacing is commonly used and is cost effective these types of installations allow more deflection in the bottom of the game fence. This can cause at least three very undesirable results: First, the animal may push the fence out far enough to escape. Second, the animal succeeds in pushing its head under the fence, realizes it can't escape and injures itself because its head is trapped between the bottom wire and the ground. Third, the unsuccessful attempt to escape has deformed the fence from preventing an effective barrier along the fence bottom.

SUMMARY OF EXAMPLES OF THE INVENTION

In at least one example of the invention, a welded wire-mesh fence panel is provided that includes a first set of substantially parallel wires, each wire having a first and a second end, a second set of substantially parallel wires, the second set of wires being welded across the first set on one picket-wire side of the first set, a cross-wire-side connection strip welded across the first end of the first set on the picket-wire side of the first set, and an opposite side connection strip welded across the second end of the first set on the opposite side of the picket-wire side. In one such example each connection strip has an outside edge and each outside edge is equally spaced from the end of the wires to which the strip is welded. In a variation of the example of the invention, a skirt may be hinged to the bottom of the wire-mesh fence panel.

In a further example of the invention, a wire-mesh fence is provided that includes: at least two wire-mesh panels. The picket-wire side connection strip of the first panel may be connected to the opposite-side connection strip of the second panel, and the first end of the wires of the first set of a first of the panels substantially facing the second end of the wires of a second panel. In at least one such example, a bolt is provided (for example, square shaped and having two ends). Each end is inserted through a hole in a connection strip of the first panel and a hold in a connection strip of the second panel. In some examples, each bolt end is threaded and a nut is applied on each threaded end. In some examples, the holes comprise slots. In still further examples, fence posts are connected at the connection strips. In another example, the holes in the connection strip are threaded to accept fasteners passing through holes in the adjoining connection strip. In another example, a skirt may be hinged to the bottom of the wire-mesh fence panel. Still further examples as seen in the attached drawings and detailed description.

In another example of the invention a wire-mesh fence panel comprises a first set of substantially parallel wires, each wire having a first, a second end, a picket-wire side, and a cross-wire side, a second set of substantially parallel wires, the second set of wires being welded across the first set on the picket-wire side, a picket-wire side connection strip welded across the first end of the first set on the picket-wire side, and a cross-wire side connection strip welded across the second end of the first set on the cross-wire side, wherein the picket-wire side connection strip includes at least one opening and the cross-wire side connection strip includes at least one opening, wherein each picket-wire side connection strip opening has a corresponding cross-wire side connection strip opening. In a variation of the example of the invention, a skirt may be hinged to the bottom of the wire-mesh fence panel.

In a variation of the examples, each connection strip has an outside edge and each outside edge is equally spaced from the end of the wires to which the strip is welded. Another variation may include the at least one picket-wire side connection strip opening is a through slot, the at least one cross-wire side connection strip opening is a through hole, and at least one fastener located through the at least one through slot and the at least one through hole. The invention may include at least one fastener being a U-shaped bolt positioned such that the ends of the U-shaped bolt are secured to the cross-wire-side connection strip.

Another example of the invention includes a wire-mesh fence comprising at least a first panel and a second panel, each panel comprising a first set of substantially parallel wires, each wire having a first and a second end, a picket-wire side, a cross-wire side, a second set of substantially parallel wires, the second set of wires being welded across the first set on the picket-wire side of the first set, a picket-wire side connection strip welded across the first end of the first set on the picket-wire side of the first set, and a cross-wire side connection strip welded across the second end of the first set on the cross-wire side of the first set, the picket-wire side connection strip of the first panel being connected to the cross-wire side connection strip of the second panel, and the first set of substantially parallel wires of the first panel being substantially aligned with the first set of substantially parallel wires of the second panel.

A further modification to the embodiments disclosed may include one or more bolts having two ends, each end being inserted through one or more holes in the picket-wire side connection strip of the first panel and one or more holes in the cross-wire side connection strip of the second panel. Each bolt end is threaded and further comprising a nut on each threaded end. Furthermore, posts may be connected to the connection strips. The hole in at least one connection strip may be slotted. Another addition may include the cross-wire-side connection strip having at least one through slot and the picket-wire side connection strip comprising at least one through hole, wherein each picket-wire-side connection strip slot has a hole that is aligned with a corresponding cross-wire-side connection strip slot. The invention may further include at least one fastener located through the at least one through slot and the at least one through hole.

Game fence effectiveness in excluding or containing animals is based on height, mesh size and shape and wire breaking strength. The mesh size of game fencing are generally dictated by the type of animals to be contained and/or excluded. The mesh size is often graduated progressively throughout the height of the mesh to prevent penetration by smaller wildlife at the bottom and enlarged toward the top of the mesh to reduce cost and weight.

Variations in wire diameter and/or wire tensile strength are used to effect strength in specific areas of the mesh where extra load is anticipated during installation and use. Typical wire diameters range from 0.0625" to 0.135" having tensile strengths between 60,000 psi to 200,000 psi.

While an effectively designed, properly installed game fence should prevent animals from jumping, breaching or climbing, it must also incorporate features to prevent tunneling. This is generally accomplished by the addition of an apron of mesh attached to the bottom of the fence that lays flat on the ground on either or both sides of the fence. This mesh can be the same type as the fence mesh or a different mesh type altogether and is typically a light gage hexagonal twisted mesh. Its primary purpose is to prevent burrowing animals from tunneling under the fence. Apron wire is generally attached to the fence and anchored to the ground after the fence is fastened to the posts as a separate operation.

According to various examples of the present invention, a welded wire mesh game fence is provided that significantly reduces installation cost and increases the performance of game fence by increasing the security of the fence and animal safety while eliminating the secondary process of installing the apron. The apron is an integral part of the fence mesh and is attached to the mesh during manufacture with hinged fasteners that allow the apron mesh to easily rotate through about 360 degrees around the bottom of the fence mesh. This allows the apron mesh to be placed on either side of the fence during installation—eliminating the time-consuming secondary step.

According to at least one aspect of the invention, welded wire mesh is manufactured in virtually any mesh size and shape with any diameter wire. The mesh size, shape and wire diameter vary within the mesh to create the most cost effective protection for a given application. For example, breeders raising smaller species may benefit from very small mesh in the range of ½ inch in the lower portion of the fence then switch to larger mesh size in the upper portion of the fence to reduce cost in areas that do not pose a risk to young animals getting heads or hoofs trapped in the mesh. Mature animals can also become fatally trapped in the large upper mesh of conventional game fence while attempting to jump over the fence. Various examples of the present invention reduce the possibility that valuable stock will become trapped in attempting to jump over the fence by virtue of its smaller upper mesh which prevents an animal's hoof catching in the mesh.

Accordingly a further aspect of the invention a fence roll is provided comprising a roll of wire-mesh fence panel, a skirt hinged to the panel portion, wherein at least one set of horizontal strands of the fence panel are unequally spread.

In at least one embodiment, the panel comprises welded mesh. In a further example, at least some of the horizontal strands (or all) comprise crimped horizontal strands. In a further example, the skirt also comprises welded mesh.

In a further example, the panel comprises a bottom strand to which the skirt is attached, a top strand, and at least a set of horizontal strands in a top half of the panel have a spacing less than at least a set of horizontal strands in a lower half of the panel.

In another example, the top half of the panel comprises a first set of horizontal strands and a second set of horizontal strands located below the first set of horizontal strands, and the spacing between the first set of horizontal strands is less than the spacing between the second set of strands. In still another example, there are least three portions of the panel, wherein a lowermost of the at least three panel portions has a first spacing, an intermediate panel portion has a second spacing, and a top portion has a third spacing. In some such examples, the first spacing is about ½ of the second spacing, and the third spacing is about equal to the first spacing, (e.g., the first spacing is about 2 inches, the second spacing is about 4 inches, and the third spacing is about 2 inches). In some such examples, a fourth panel portion is provided having a 3 inch spacing, and a fifth panel portion has a 6 inch spacing.

In still further examples, each of the three spacing is different from the others. Alternatively, the first and the third spacings are equal and more narrow than the second spacing. In at least one example, the first spacing comprises about ½ the spacing of the second spacing, and the third spacing comprises about three times the spacing of the first spacing.

In still another example, the skirt comprises crimped horizontal strands, a top wire comprises a heavier gauge than a substantial portion of other horizontal wires, and a bottom wire comprises a heavier gauge than a substantial portion of the other horizontal wires. In some examples, a substantial portion of the horizontal wires of the skirt comprise a heavier gauge than a substantial portion of the horizontal wires of the panel portions, and the mesh size of the skirt is smaller than the mesh size of the panel portions.

In other examples, the intermediate panel portion comprises an upper intermediate portion and a lower intermediate portion. In still other examples, the spacing of all portions increase from the bottom portion to the top portion, in approximately one inch increments, beginning with a substantially three inch bottom spacing.

In some examples, the skirt is connected to the panel portion with approximately 360 degree rotational freedom of motion in an unrolled state (e.g., a hinged connection, for example, a c-ring). In a more detailed example, the spacing of the skirt comprises approximately 1.5 inches and the horizontal wires comprise approximately 16-gauge, crimped wire having a crimp angle of approximately 90 degrees.

According to yet another aspect of the invention, a process is provided comprising following uneven terrain and providing resiliency with a wire mesh fence of a height sufficient to deter game animals from jumping the fence, deterring penetration of wildlife smaller than game animals from penetrating the fence, deterring climbing of the fence by game animals, and providing installation of a skirt portion of the fence, during unrolling installation of the fence, on either side of the fence.

In at least one example of the present aspect, the process further comprises deterring the trapping of a game animal attempting to climb the fence and stiffening a lower portion of the fence.

According to a further aspect of the invention, a system is provided. In at least one example, the system comprises means for following uneven terrain and providing resiliency with a wire mesh fence of a height sufficient to deter game animals from jumping the fence, means for deterring penetration of the fence by wildlife smaller than game animals, means for deterring climbing of the fence by game animals, and means for providing installation of a skirt portion of the fence, during unrolling installation of the fence, on either side of the fence.

In at least one example, the system further comprises means for deterring the trapping of a game animal attempting to climb the fence (e.g., reduced spacing of horizontal wires in a top portion of the fence). In a further example, the system further comprises means for stiffening a lower portion of the fence (e.g., a bottom wire of a gauge greater than at least some of horizontal wires of a panel portion of the fence.

In a further example, the means for following uneven terrain and providing resiliency comprises a crimp in at least some or all horizontal wires of the fence. In some examples, the means for deterring penetration of the fence by wildlife smaller than game animals comprises reduced spacing of horizontal wires in a lower portion of the fence.

In at least one example, the means for deterring climbing of the fence by game animals comprises a band of smaller mesh through the center of height. In still further examples, the means for providing installation of a skirt portion of the fence, during unrolling installation of the fence, on either side of the fence, comprises a hinged connection of the skirt to the bottom of the fence such that the freedom of rotation of the skirt around the bottom of a panel portion of the fence is sufficient for the skirt to be rolled in the fence along one side of the panel portion and also to be pivoted around the bottom of the fence during unrolling. In yet another example, the means for providing installation of a skirt portion comprises c-rings pivotally holding the skirt to a bottom wire of a panel portion of the fence.

In another example the invention may include, a wire-mesh fence comprising a panel portion comprising a first set of substantially parallel wires, each wire having a first, a second end, a picket-wire side, and a cross-wire side, a second set of substantially parallel wires, the second set of wires being welded across the first set on the picket-wire side, a picket-wire side connection strip welded across the first end of the first set on the picket-wire side, and a cross-wire side connection strip welded across the second end of the first set on the cross-wire side, wherein the picket-wire side connection strip includes at least one opening and the cross-wire side connection strip includes at least one opening, wherein each picket-wire side connection strip opening has a corresponding cross-wire side connection strip opening, a skirt hinged to the panel portion.

A variation of the invention may include a connection strip having an outside edge and each outside edge is equally spaced from the end of the wires to which the strip is welded. The example may include the at least one picket-wire side connection strip where opening is a through slot. The example may include the at least one cross-wire side connection strip opening being a through hole. The example may further comprise at least one fastener located through the at least one through slot and the at least one through hole. The example may include the at least one fastener having a U-shaped bolt positioned such that the ends of the U-shaped bolt are secured to the cross-wire-side connection strip. The example may include the skirt comprising a welded mesh—hexagonal twisted mesh. The example may include the skirt comprising a knotted mesh. The example may include the skirt comprising a wrapped mesh. The example may include a bottom wire comprising a heavier gauge than a substantial portion of the other horizontal wires. The example may include a substantial portion of the horizontal wires of the skirt comprising a heavier gauge than a substantial portion of the horizontal wires of the panel portions. The example may include the mesh size of the skirt being smaller than the mesh size of the panel portions. The example may include the skirt being connected to the panel portion with approximately 360 degree rotational freedom of motion in an unrolled state. The example of the invention may include a connection to the panel portion comprising a hinged connection. The example of the invention may include the skirt hinged to the panel portion above a bottom wire of the panel portion.

In another example of the invention, a wire-mesh fence comprising at least a first panel and a second panel, each panel comprising a first set of substantially parallel wires, each wire having a first and a second end, a picket-wire side, a cross-wire side, a skirt hinged to the first panel and the second panel, a second set of substantially parallel wires, the second set of wires being welded across the first set on the picket-wire side of the first set, a picket-wire side connection strip welded across the first end of the first set on the picket-wire side of the first set, and a cross-wire side connection strip welded across the second end of the first set on the cross-wire side of the first set, the picket-wire side connection strip of the first panel being connected to the cross-wire side connection strip of the second panel, and the first set of substantially parallel wires of the first panel being substantially aligned with the first set of substantially parallel wires of the second panel.

A variation of the invention may include a fence comprising one or more bolts having two ends, each end being inserted through one or more holes in the picket-wire side connection strip of the first panel and one or more holes in the cross-wire side connection strip of the second panel. The example of the invention may include each bolt end threaded and further comprising a nut on each threaded end. Another variation of the invention may include posts connected to the connection strips. A variation of the invention may include a hole in at least one connection strip being slotted. Another variation of the invention may include a cross-wire-side connection strip having at least one through slot and the picket-wire side connection strip comprising at least one through hole, wherein each picket-wire-side connection strip slot has a hole that is aligned with a corresponding cross-wire-side connection strip slot. A variation of the invention may include at least one fastener located through the at least one through slot and the at least one through hole. Another variation of the invention may include the skirt comprising welded mesh—hexagonal twisted mesh, knotted mesh or wrapped mesh. Another variation of the example of the invention may include a bottom wire comprising a heavier gauge than a substantial portion of the other horizontal wires.

A variation of the invention may include a substantial portion of the horizontal wires of the skirt comprising a heavier gauge than a substantial portion of the horizontal wires of the panel portions. Another variation of the invention may include the mesh size of the skirt being smaller than the mesh size of the first panel and second panel, the skirt being connected to the first panel and the second panel with approximately 360 degree rotational freedom of motion, a connection to the first panel and second panel comprising a hinged connection or the skirt being hinged above a bottom wire of the first panel and second panel.

In yet another example, a fence roll is provided wherein a predator skirt is attached to the vertical panel some distance above the bottom to allow the bottom portion of the vertical mesh to be burred but to still allow the predator skirt to unfold flat on the ground.

DETAILED DESCRIPTION OF EXAMPLES OF THE INVENTION

Figure 1A:
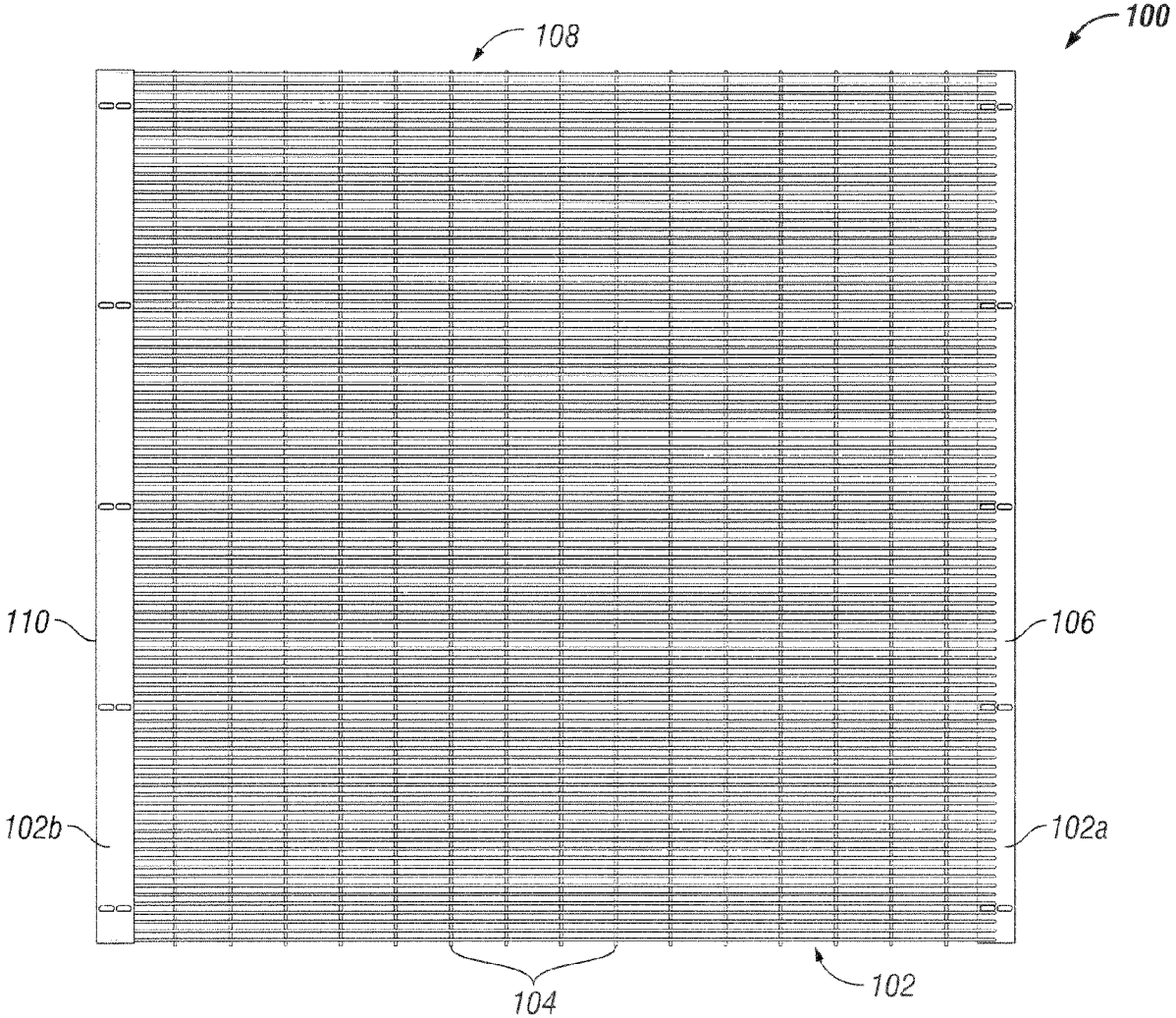
FIG. 1A is a front view of an example of the invention in which a wire-mesh panel is seen.
Figure 1C:
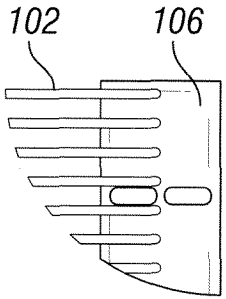
FIG. 1C is a detail view of the upper right corner of the wire mesh panel of FIG. 1A.
Figure 1E:
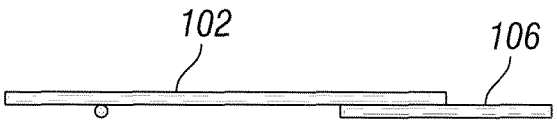
FIG. 1E is an end on view of the lower right corner of the wire mesh panel of FIG. 1A.
Figure 1B:
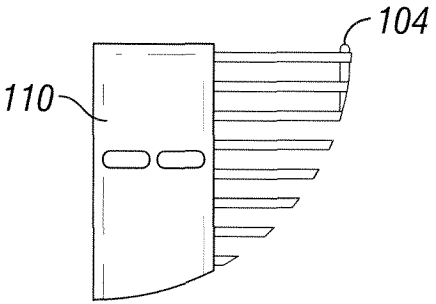
FIG. 1B is a detail view of the upper left corner of the wire mesh panel of FIG. 1A.
Figure 1D:
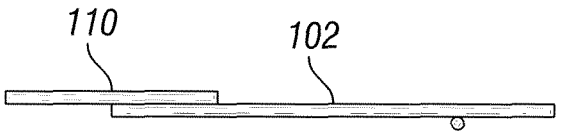
FIG. 1D is an end on view of the lower left corner of the wire mesh panel of FIG. 1A.

Referring now to FIG. 1A an example of a wire-mesh fence panel 100 is seen comprising substantially parallel rail-wires 102, each having a first end 102*a* and a second end 102*b*. Substantially parallel cross-wires 104 are welded across rail-wires 102 at substantially regular intervals. At each end of the panel 100 a connection strip is welded across the ends of the wires 102. As seen in detail in FIG. 1A-1E, picket wire-side-connection strip 106 is welded on the picket-wire side 108 of panel 100, and opposite-side connection strip 110 is welded across the ends of the wires 102 on the side opposite the picket-wire side 108 of panel 100.

Figure 2:
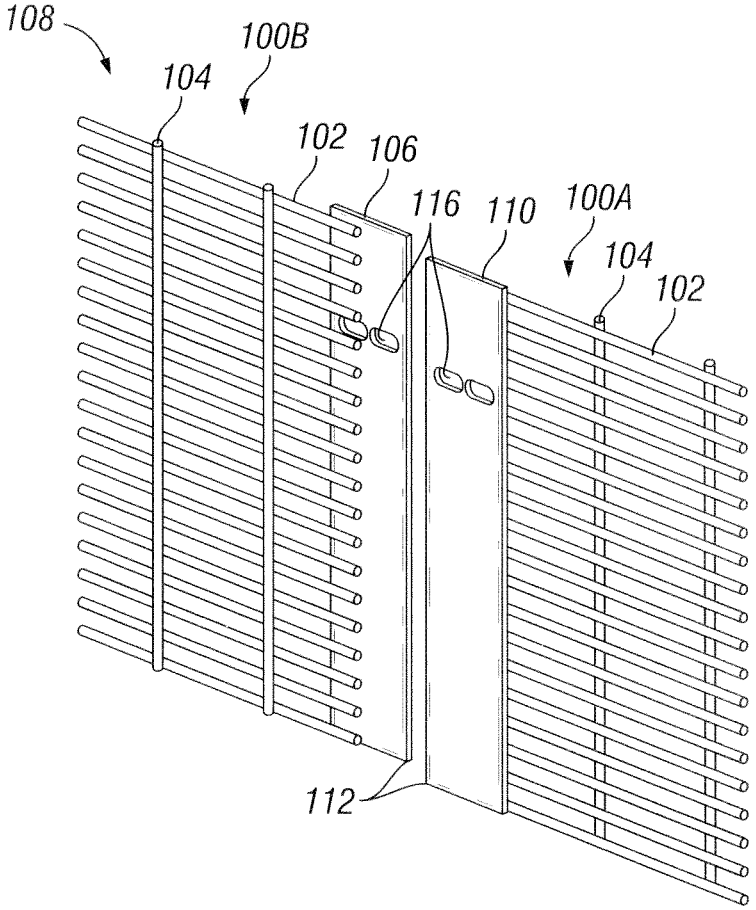
FIG. 2 is a perspective view of an example of the invention in which two wire-mesh panels such as that illustrated in FIG. 1A are spaced apart before joining.

Referring now to the example of FIG. 2, each connection strip 106 and 110 has an outside edge 112 that is spaced from the end of the wires to which the strip is welded. As the two panels 100*a* and 100*b* are moved together, the ends of the rail-wires face each other; and, if the spacing is regular enough, as seen in the top-view of FIG. 3, this allows a "butt-connection" between the wires of two panels 100*a* and 100*b* when they are connected together.

Referring again to FIG. 2, slot-holes 116 are provided in each connection strip and are positioned to overlap with the slot-holes of another panel when assembled. Such slots allow for irregular spacing of posts to be accommodated.

Referring again to FIG. 3, in at least one example of the invention, a U-shaped bolt 204 is inserted from the side opposite the picket-wire-side of panels 100*a* and 100*b* through slots 116 (not shown in FIG. 3), and nuts 210 are applied to the threaded ends of bolt 204. Therefore, it is possible to build an entire fence on which no nuts or cross-wires are available on one side of the fence. Having the cross-wires inaccessible to the outside increases the security of the fence. When used as the outside of whatever location is to be protected, this increases security because the back of a U-shaped bolt is more difficult to attack than a nut. Other methods of joining panels will occur to those of skill in the art without departing from the invention.

Figure 4:
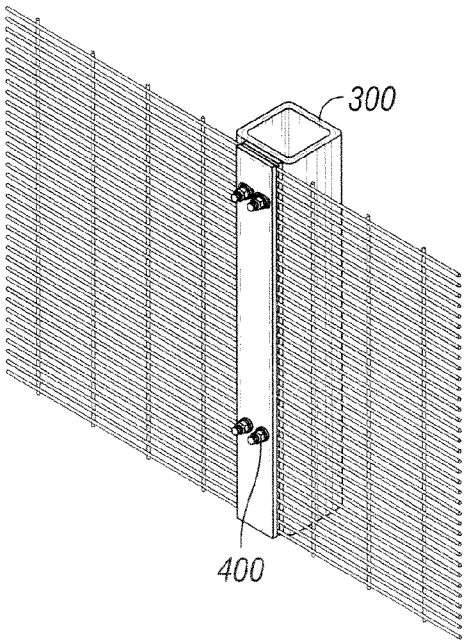
FIG. 4 is a perspective view of an example of the invention, in which connected panels are mounted to a fence post.
Figure 6:
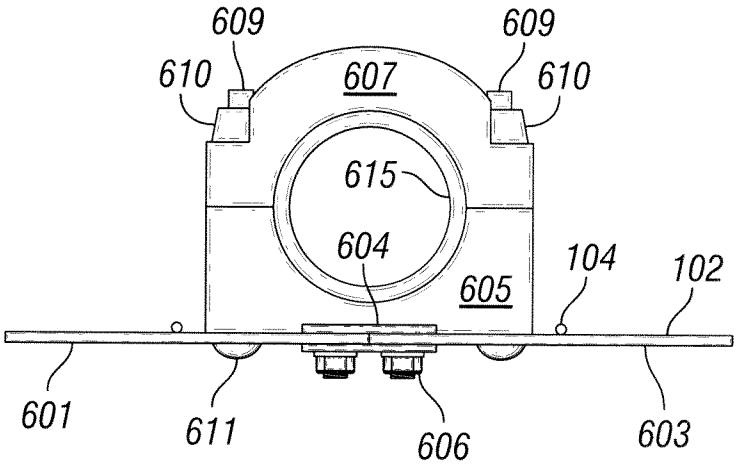
FIG. 6 is a top view of connected panels attached to a fence post.
Figure 5:
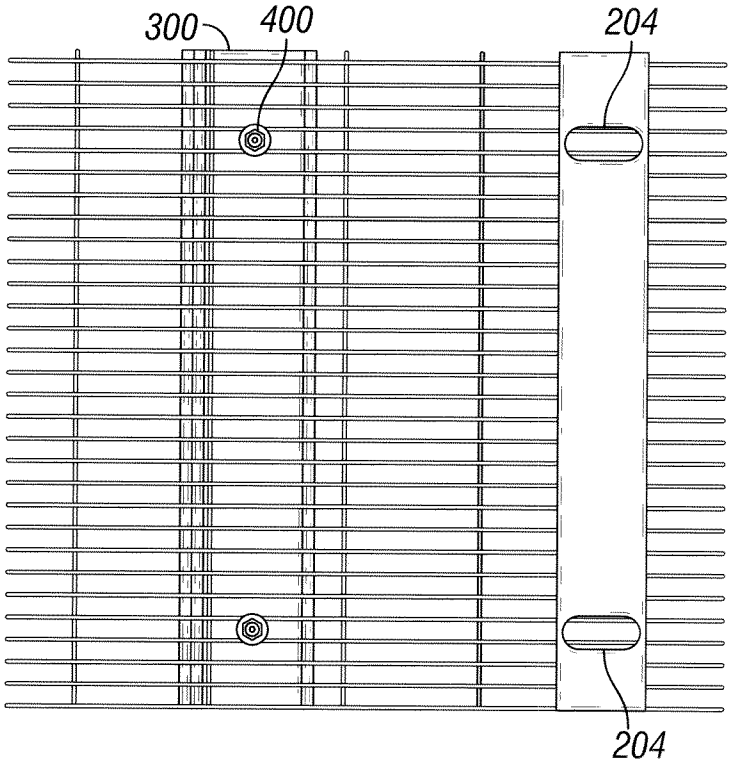
FIG. 5 is a front view of connected panels attached to a fence post.

As illustrated in FIG. 4, in some examples, the overlapping connection strips are attached by bolts 400 (e.g., secure bolts who's heads shear after installation) to threaded posts 300 that have been previously set in the ground. In other examples, the spacing between posts is too irregular and cannot be attached at the connection strips (see FIG. 5). However due to the overlapping connection strips being welded to the ends of the wires, the assembled panels present a uniform barrier that can be attached to irregularly spaced posts with hardware that will occur to those of skill in the art. For example, the following types of connectors are useful to mount joined panels to posts: standard threaded fasteners, threaded tamper proof fasteners, welded studs, rivets, self tapping standard and tamper proof fasteners, direct welding, etc. Referring now to FIG. 6, still another example is seen in which joined panels 601 and 603 are connected by strips 604, which are held together by bolts 606 that are threaded into block 605. The assembled panels are fastened to round posts 615 by clamp member 607 which is secured to block 605 by bolts 609 (held in place by nuts 610 and heads 611.)

In some embodiments, the connection strips 106 and 110 are welded during manufacturing, to the picket-wires of a wire-mesh welding processed panel. In further examples, strips 106 and 110 are welded to the so-called "rail-wires". In still a further example, strips are welded to more than two sides (e.g. four), allowing panels to be joined in two dimensions. Thus higher fences are enabled from multiple panels of one height.

The materials and sizes of the mesh are known to those of ordinary skill in the field. For example, the following materials and sizes of the mesh have been found to be useful: a 12 gage (0.120 inch diameter) through 4 gage (0.225 inch diameter) wire welded into a 3"×0.5" mesh, a 12 gage (0.120 inch diameter) through 4 gage (0.225 inch diameter) wire welded into a 2"×2" mesh, a 12 gage (0.120 inch diameter) through 4 gage (0.225 inch diameter) wire welded into a 2"×6" mesh, or a 12 gage (0.120 inch diameter) through 4 gage (0.225 inch diameter) wire welded into 1"×1" mesh. Other dimensions and even more irregular spacing of wires may be used without departing from the invention.

Figure 7:
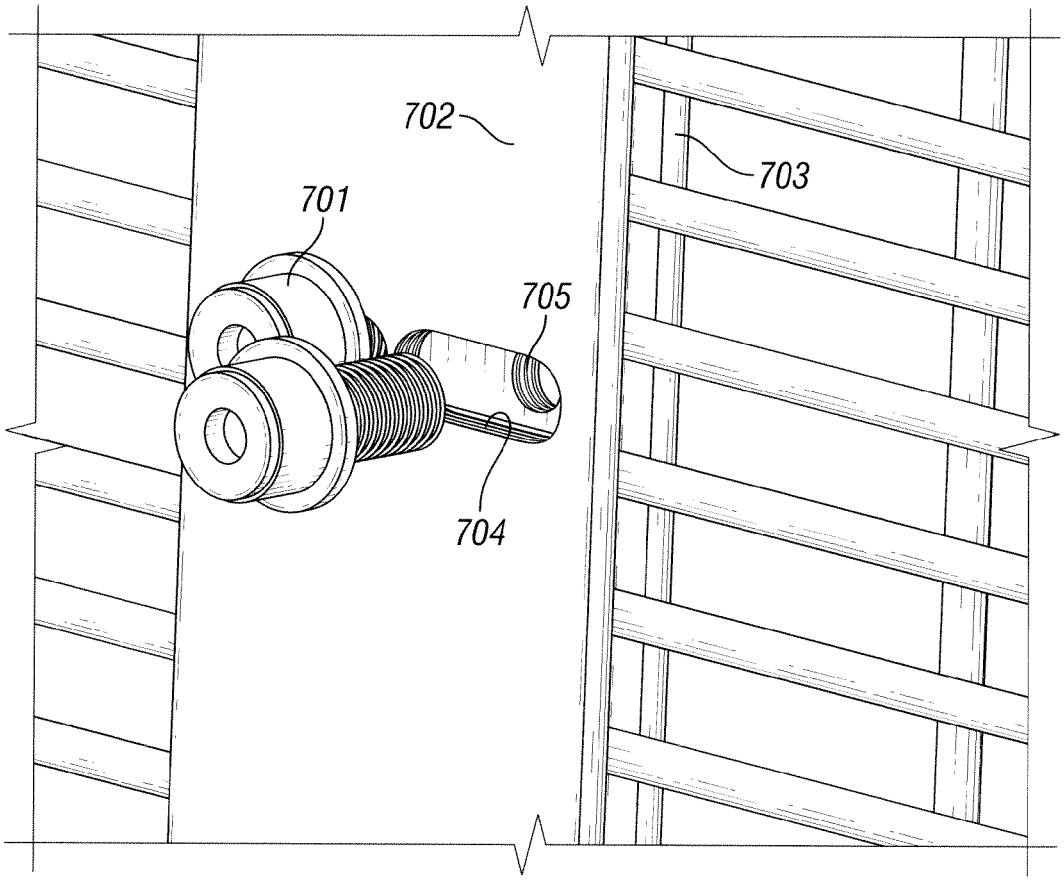
FIG. 7 is a side view of the connected panels attached to each other.

As illustrated in FIG. 7, in some examples, the overlapping connection strips 702 are attached by bolts 701 to corresponding threaded strips 703. The assembled panels allow for a uniform barrier that can be attached to irregularly spaced posts with hardware that will occur to those of skill in the art. For example, the following types of connectors are useful to join the connection strips 702 to the threaded strips 703: standard threaded fasteners, threaded tamper proof fasteners, welded studs, rivets, self-tapping standard and tamper proof fasteners, direct welding, etc. In this example the connection strip 702 has a slot 704 and the corresponding threaded strip 703 has a through hole 705.

Figure 8:
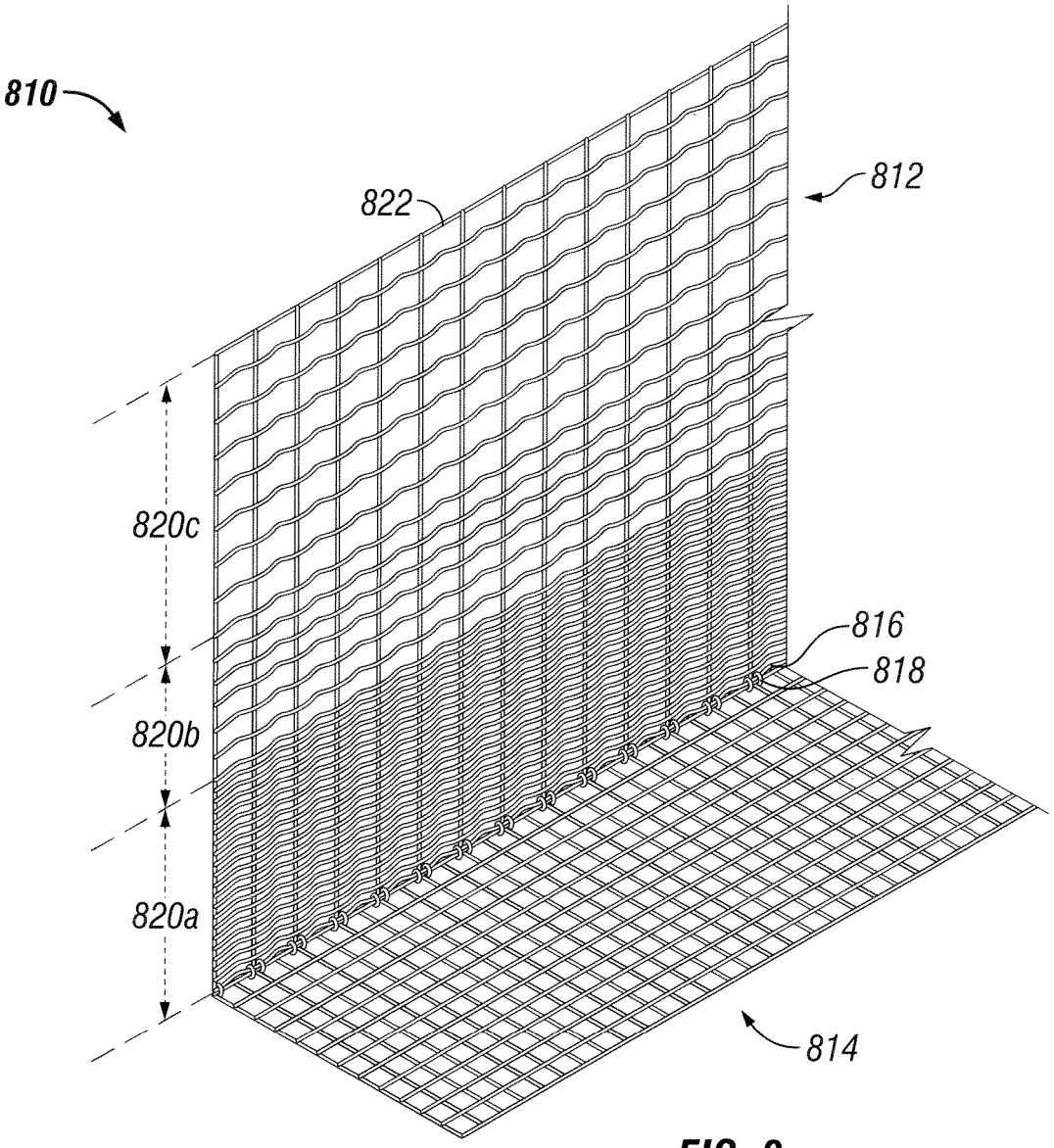
FIG. 8 is an isometric view of an example of the present invention.

Referring now to FIG. 8, an unrolled wire-mesh fence 810 is seen having a panel portion 812 and a skirt portion 814 (aka an "anti-dig panel). The skirt 814 is joined in the illustrated example to the panel portion 812 by the lower wire strand 816 of the panel portion 812 in a hinged fashion by, for example, a c-ring 818 (or so-called "hog ring"). In the illustrated example, skirt 814 comprises a 4-inch by 4-inch square mesh, although other mesh sizes and shapes are within the scope of the present invention as will occur to those of ordinary skill in the art. Considerations for other mesh shapes and sizes for the skirt include the size and type of expected varmints/predators. For example, wild hogs would need 8-10 gauge strand in 3-inch by 3-inch or 4-inch by 4-inch mesh. Coyotes, skunks and raccoons need 14-12 gauge 2-inch by 2-inch mesh.

Figure 9B:
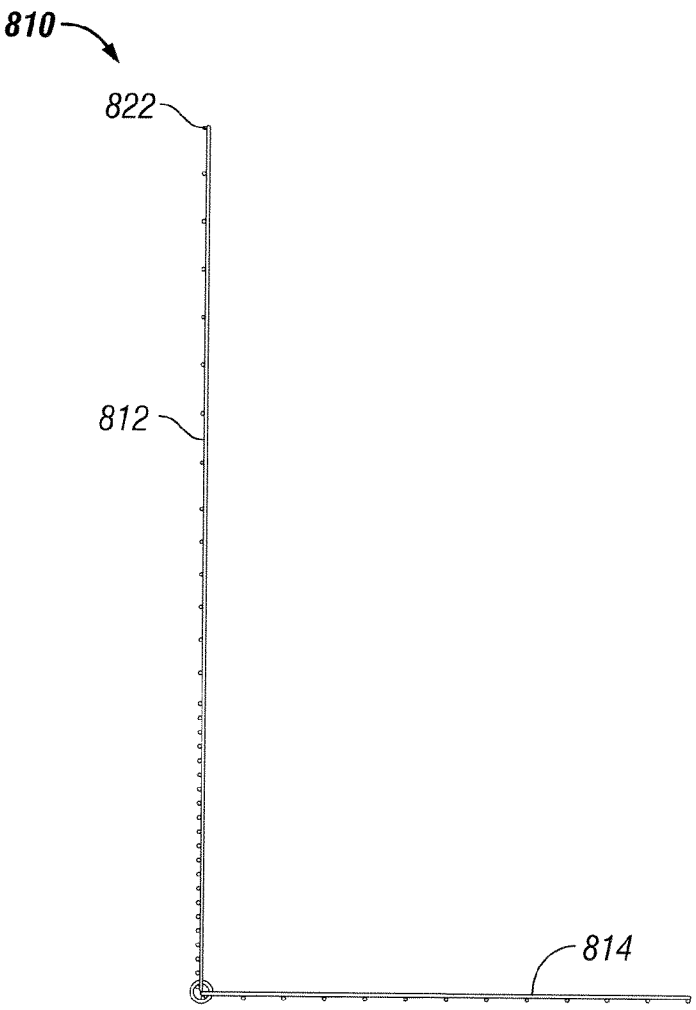
FIGS. 9A and 9B are side views of an example of the present invention.
Figure 9A:
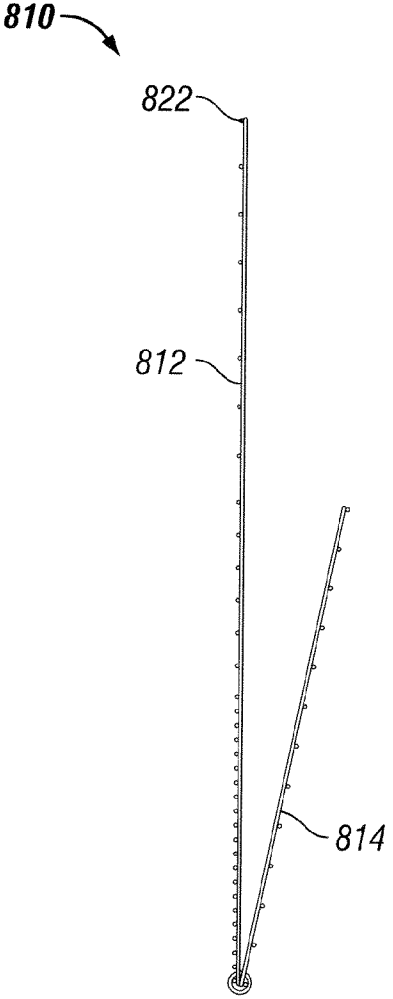

As also seen in FIG. 9A, skirt 814 may be 48-inches, while the panel portion is for a so-called "high fence" (for example, 108-inches). These proportions result from the following considerations: terrain, whether flat or hilly; type of animals to be managed, for example, ostrich or an impala or a deer; type of predator to be excluded, for example, pigs, cats or coyotes.

The panel portion 812 in FIG. 9A comprises 8-inch by 6-inch wire-mesh having crimped horizontal wires (e.g., about 90 degrees), with three different spacings: 2-inches in a lower portion 820*a* having a height of 36-inches, 4-inches in an intermediate portion 820*b* having a height of about 24-inches, and 6-inches in an upper portion 820*c* having a height of about 48-inches. Also, the top wire 822 comprises 8-gauge wire, being a higher thickness than the 12.5 gauge wires of the rest of the panel portion 812. In some examples, all wires comprise high tensile, class 1 galvanized wire; in others all wires comprise class 3 wire. In some examples, all wires are welded at all crossings, reducing the thickness of the panels and increasing the ability to fold skirt 814 against panel portion 812 for rolling and transportation.

Referring still to FIG. 9A, a side view of the fence 810 of FIG. 8 is seen with the skirt 814 partly folded against panel portion 812. As seen, the illustrated example comprises welded wire mesh, allowing for a thinner fence in cross section and allowing for a tighter roll of the fence 10 with less chance of interference between the skirt and the panel portion.

FIG. 9B shows the same fence 810 with skirt 814 folded out as if it were to lay along the ground.

Figure 9C:
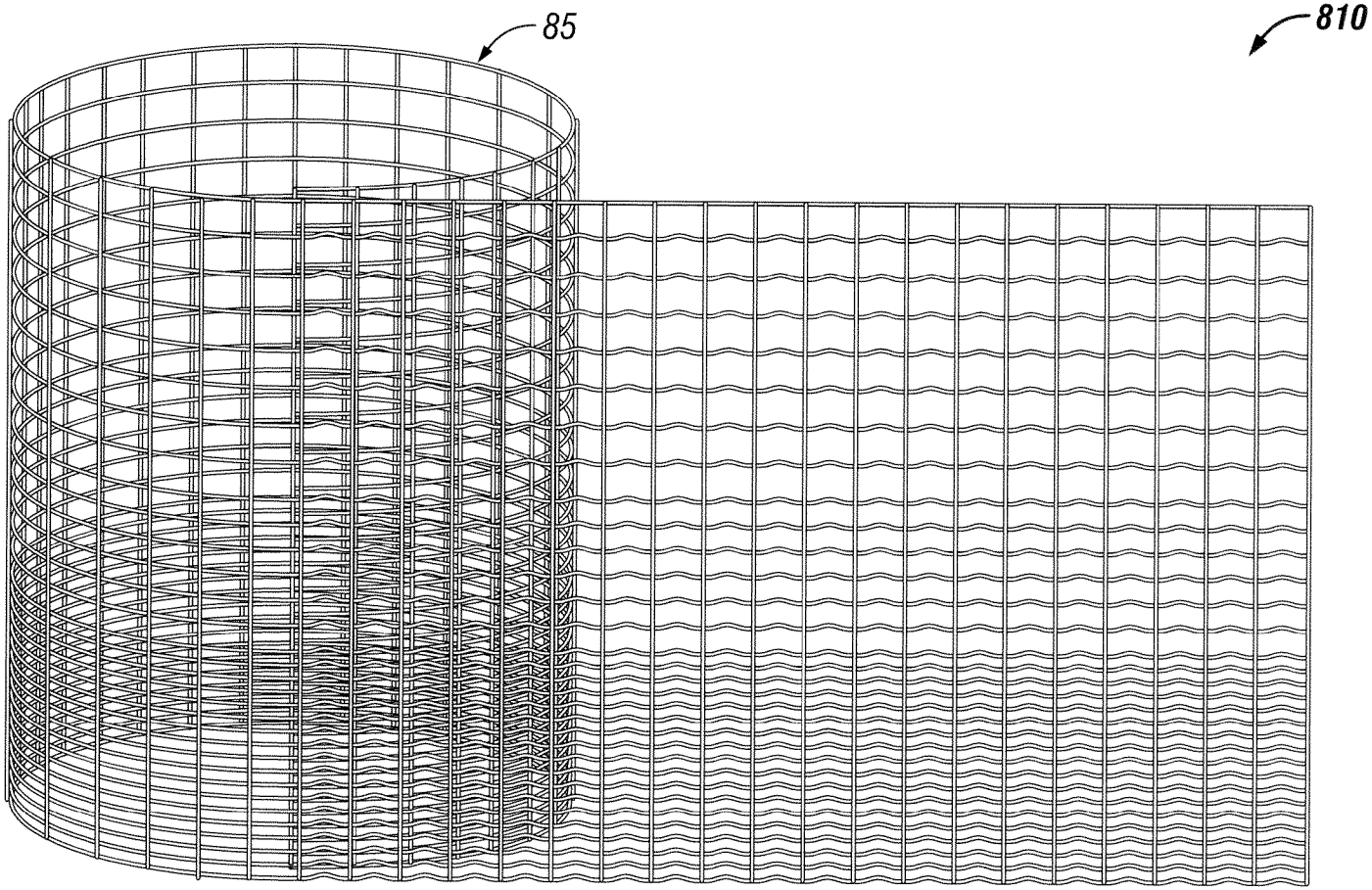
FIG. 9C is an isometric view of an example of the present invention.

Referring to FIG. 9C, fence 810 has been rolled into fence roll 85, ready for transportation to an installation site. In the illustration, crimping is not shown for simplicity; however, in many examples the horizontal wires in roll 85 are crimped.

Figure 10:
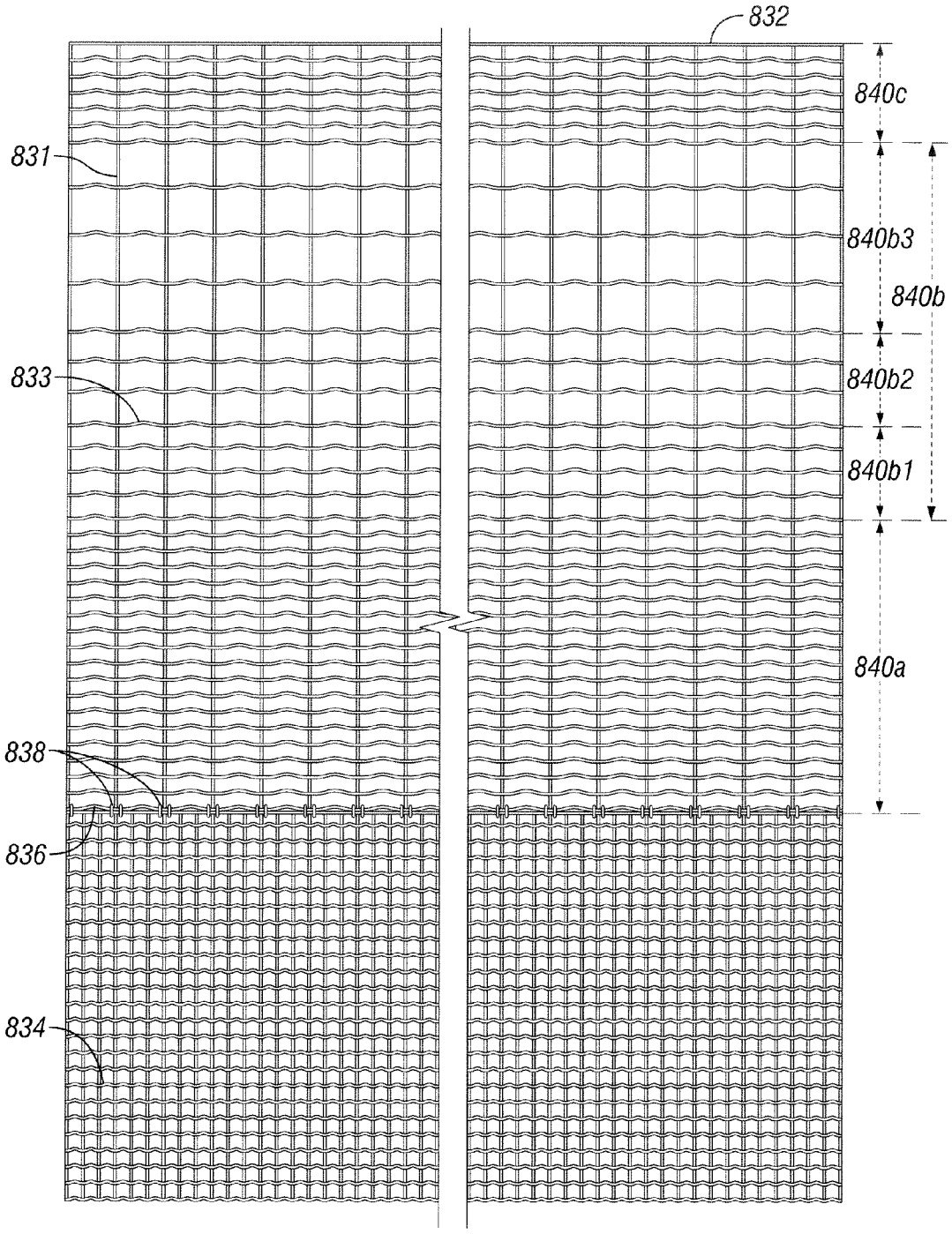
FIG. 10 is an elevation view of an example of the present invention.

Referring now to FIG. 10, an elevation view of a further example fence 830 is seen having, alternatively, a length of between about 150 and 300 feet, a 3-foot bottom portion

Figure 3:
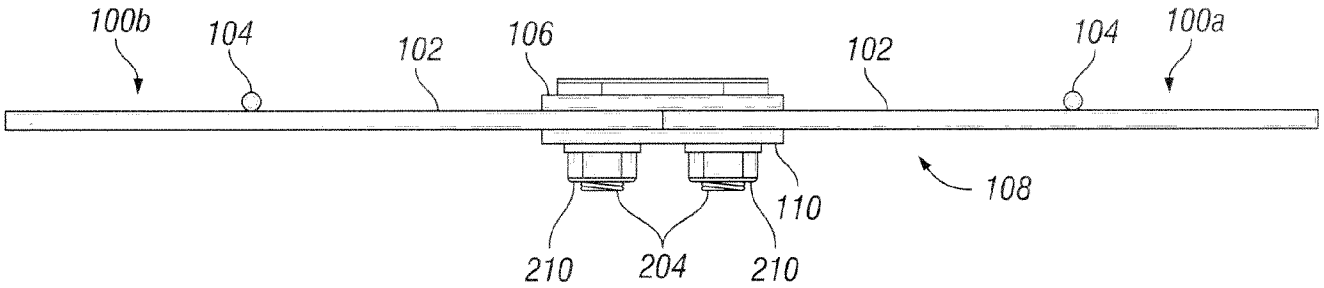
FIG. 3 is a top view of an example of the invention, showing a butt-joint of two assembled panels.

840*a*, comprising a 2×6 inch wire-mesh with straight 12.5 gauge vertical wires 831 and crimped 12.5 gauge horizontal wires 833, a 4-foot intermediate portion 840*b* of the same wires on a larger mesh, and a 1-foot top portion 840*c* of the same wires (other than 8-gauge top wire 832), having a 2×6 mesh size. As illustrated, intermediate portion 840*b* is, itself, subdivided into intermediate portions 840*b*1, 840*b*2, and 830*b*3, having mesh sizes 3×6 inch, 4×6 inch, and 6×6 inch, respectively. Also seen in FIG. 3 is a 4-foot skirt 834, attached to panel portion 832 by c-rings 838 at bottom wire 836. In the illustrated example, skirt 844 comprises a 2-inch square welded metal mesh of 14-gauge wire.

Figure 11:
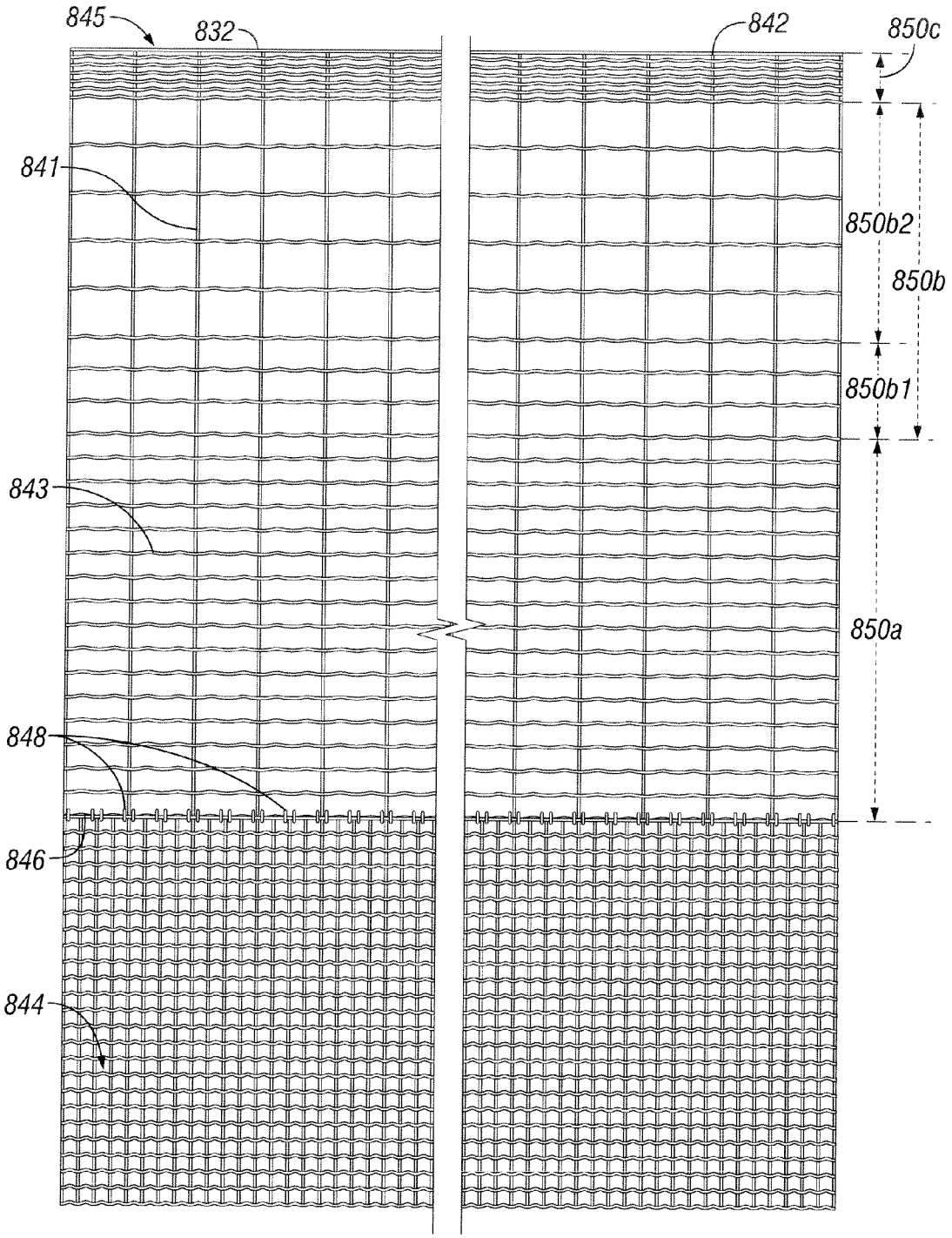
FIG. 11 is an elevation view of an example of the present invention.

Referring now to FIG. 11, an elevation view of a further example fence 845 is seen having, alternatively, a length of between about 150 and 300 feet, a 4-foot bottom portion 850*a*, comprising a 3×8 inch wire-mesh with straight 12.5 gauge vertical wires 841 and crimped 12.5 gauge horizontal wires 843, a 3.5-foot intermediate portion 850*b* of the same wires on a larger inch mesh, and a 6-inch top portion 850*c* of the same wires (other than 8-gauge top wire 832), having a 1×8 inch mesh size. As illustrated, intermediate portion 850*b* is, itself, subdivided into intermediate portions 850*b*1 and 850*b*2, having mesh sizes 4×8 inch and 6×8 inch, respectively. Also seen in FIG. 11 is a 4-foot skirt 844, attached to panel portion 842 by c-rings 848 at bottom wire 846. In the illustrated example, skirt 844 comprises a 2-inch square welded metal mesh of 16-gauge wire.

Figure 12:
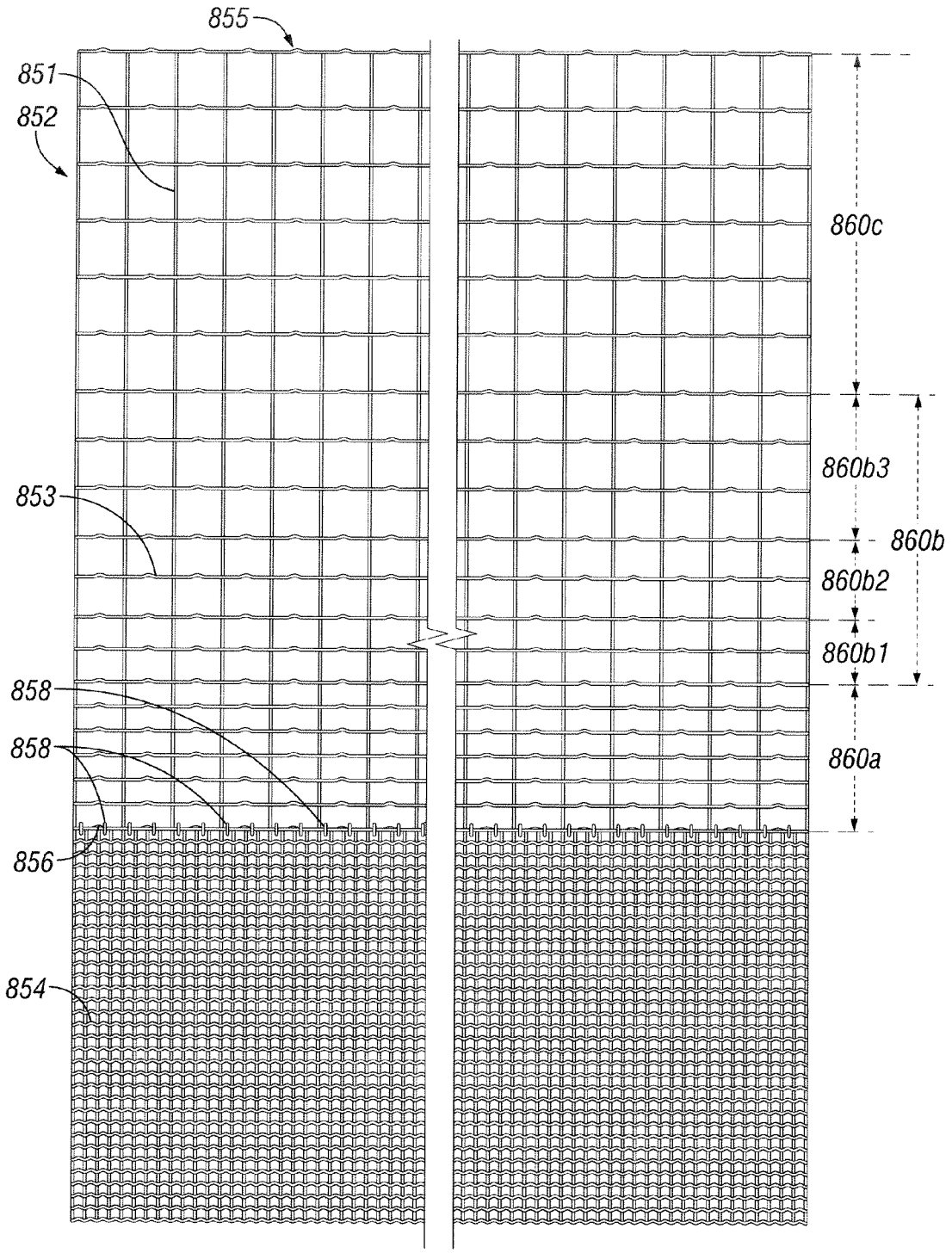
FIG. 12 is an elevation view of an example of the present invention.

Referring now to FIG. 12, an elevation view of a further example fence 855 is seen having, alternatively, a length of between about 150 and 300 feet, an 18-inch bottom portion 860*a*, comprising a 3×6 inch wire-mesh with straight 12.5 gauge vertical wires 851 and crimped 12.5 gauge horizontal wires 853, a 32-inch intermediate portion 860*b* of the same wires on a larger mesh, and a 52-inch top portion 860*c* of the same wires (including top wire 855) having a 2×6 mesh size. As illustrated, intermediate portion 860*b* is, itself, subdivided into intermediate portions 860*b*1, 860*b*2, and 860*b*3, having mesh sizes 4×6 inch, 5×6 inch, and 6×6 inch, respectively. Also seen in FIG. 12 is a 4-foot skirt 854, attached to panel portion 852 by c-rings 858 at bottom wire 856. In the illustrated example, skirt 854 comprises a 2-inch square welded metal mesh of 14-gauge wire.

It has been found that an optimal combination of mesh sizes, wire gauges, and other dimensions, for most high-fence game applications, is that illustrated in FIG. 10.

Further alternative materials include: wire metallic coated with 5% AMM, Zn (Galfan) to increase life of uncoated welded mesh.

Figure 13:
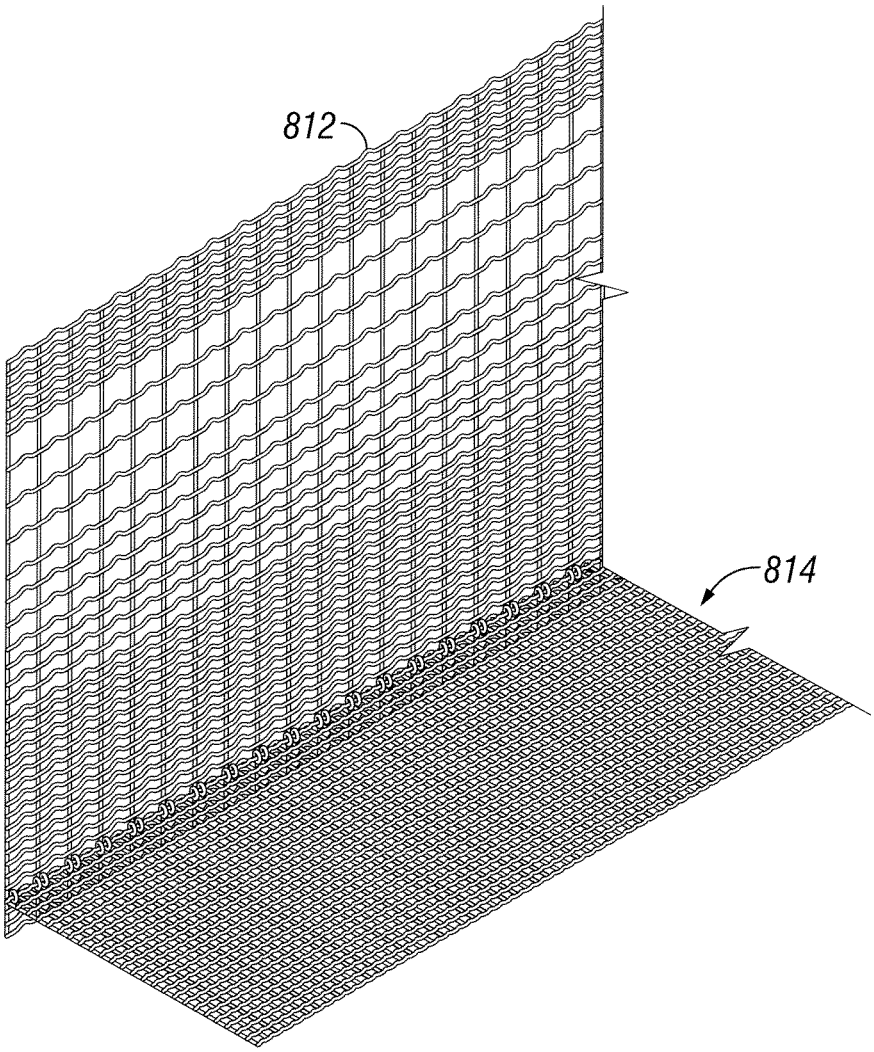
FIG. 13 is an isometric view of an example of the present invention.

As seen in FIG. 13, according to an alternative example a fence roll is provided (shown in an unrolled state) that has the predator a skirt 814 attached to the vertical panel 812 some distance above the bottom (here, for example, 6 inches) to allow the bottom portion of the vertical mesh to be burred but to still allow the predator skirt 814 to unfold flat on the ground.

In some examples, rather than welding, the wire mesh is constructed by wrapping a vertical wire around a horizontal wire while, in others, a knot of wire holds the vertical to the horizontal wires.

Figure 14:
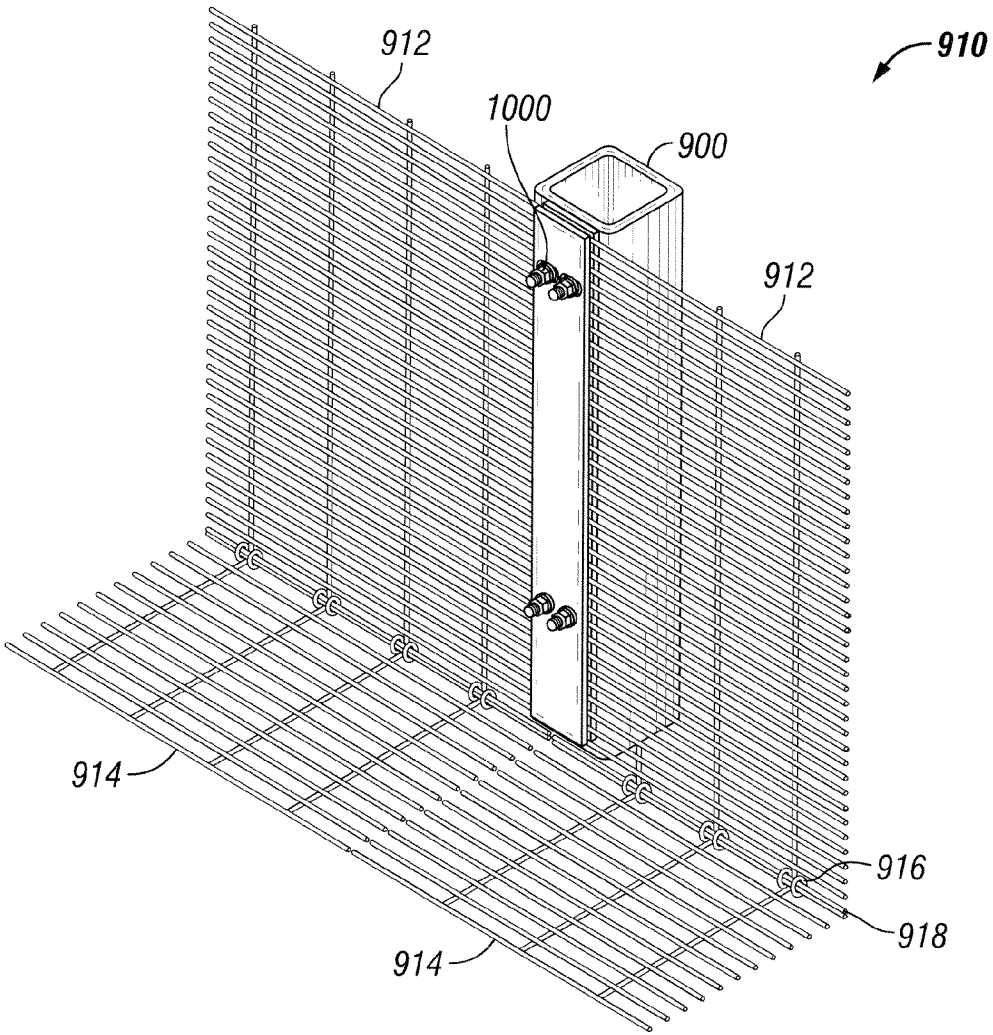
FIG. 14 is another isometric view of an example of the present invention.

As illustrated in FIG. 14, in some examples, the overlapping connection strips are attached by bolts 1000 (e.g., secure bolts who's heads shear after installation) to threaded posts 900 that have been previously set in the ground. The overlapping connection strips being welded to the ends of the wires present a uniform barrier that can be attached to irregularly spaced posts with hardware that will occur to those of skill in the art. For example, the following types of connectors are useful to mount joined panels to posts: standard threaded fasteners, threaded tamper proof fasteners, welded studs, rivets, self tapping standard and tamper proof fasteners, direct welding, etc. The wire-mesh fence 910 is seen having a panel portion 912 and a skirt portion 914 (aka an "anti-dig panel"). The skirt 914 is joined in the illustrated example to the panel portion 912 by the lower wire 918 of the panel portion 912 in a hinged fashion by, for example, a c-ring 916 (or so-called "hog ring"). In the illustrated example, skirt 914 comprises a 4-inch by 4-inch square mesh, although other mesh sized and shapes are within the scope of the present invention as will occur to those of ordinary skill in the art. Considerations for other mesh shapes and sizes for the skirt include the size and type of expected varmints/predators. For example, wild hogs would need 8-10 gauge strand in 3-inch by 3-inch or 4-inch by 4-inch mesh. Coyotes, skunks and raccoons need 14-12 gauge 2-inch by 2-inch mesh.

The above description is given by way of example only. Other examples of the invention will occur to those reading the current document that are within the scope of the invention—whose scope is not intended to be limited by any statement or specific example given above. The scope of the patent is intended to be defined only by the claims which follow. Likewise, the figures are illustrative and not necessarily to scale. No limitation or disclaimer of the scope of the invention is intended by any term or phase used in the sections of this document, and the scope and all legitimate equivalents, whether disclosed in this document or not, whether now-existing or created in the future.

What is claimed is:

1. A wire-mesh fence comprising:

a panel portion comprising:

a first set of substantially parallel wires, each wire having a first, a second end, a picket-wire side, and a cross-wire side;

a second set of substantially parallel wires, the second set of wires being welded across the first set on the picket-wire side;

a picket-wire side connection strip welded across the first end of the first set on the picket-wire side; and a cross-wire side connection strip welded across the second end of the first set on the cross-wire side, wherein the picket-wire side connection strip includes at least one opening and the cross-wire side connection strip includes at least one opening, wherein each picket-wire side connection strip opening has a corresponding cross-wire side connection strip opening;

a skirt hinged to the panel portion.

2. A wire-mesh fence as in claim 1, wherein each connection strip has an outside edge and each outside edge is equally spaced from the end of the wires to which the strip is welded.

3. A wire-mesh fence as in claim 1, wherein the at least one picket-wire side connection strip opening is a through slot.

4. A wire-mesh fence comprising:

at least a first panel and a second panel, each panel comprising:

a first set of substantially parallel wires, each wire having a first and a second end, a picket-wire side, a cross-wire side, a skirt hinged to the first panel and the second panel, a second set of substantially parallel wires, the second set of wires being welded across the first set on the picket-wire side of the first set, a picket-wire side connection strip welded across the first end of the first set on the picket-wire side of the first set, and a cross-wire side connection strip welded across the second end of the first set on the cross-wire side of the first set;

the picket-wire side connection strip of the first panel being connected to the cross-wire side connection strip of the second panel; and the first set of substantially parallel wires of the first panel being substantially aligned with the first set of substantially parallel wires of the second panel.

5. A wire-mesh fence as in claim 4, wherein the skirt is connected to the first panel and the second panel with approximately 360 degree rotational freedom of motion.

6. A wire-mesh fence as in claim 4, wherein the first panel is hinged to the second panel and comprises a hinged connection.

7. A wire-mesh fence as in claim 4, wherein the skirt is hinged above a bottom wire of the first panel and second panel.

8. A wire-mesh fence panel comprising:

a first set of substantially parallel wires, each wire having a first, a second end, a picket-wire side, and a cross-wire side;

a second set of substantially parallel wires, the second set of wires being welded across the first set on the picket-wire side;

a picket-wire side connection strip welded across the first end of the first set on the picket-wire side; and a cross-wire side connection strip welded across the second end of the first set on the cross-wire side, wherein the picket-wire side connection strip includes at least one opening and the cross-wire side connection strip includes at least one opening, wherein each picket-wire side connection strip opening has a corresponding cross-wire side connection strip opening.

9. A wire-mesh fence panel as in claim 8, wherein each connection strip has an outside edge and each outside edge is equally spaced from the end of the wires to which the strip is welded.

10. A wire-mesh fence panel as in claim 8, wherein the at least one picket-wire side connection strip opening is a through slot.

11. A wire-mesh fence panel as in claim 10, wherein the at least one cross-wire side connection strip opening is a through hole.

12. A wire-mesh fence panel as in claim 11, further comprising at least one fastener located through the at least one through slot and the at least one through hole.

13. A wire-mesh fence panel as in claim 12, wherein the at least one fastener is a U-shaped bolt having two leg portions positioned such that the ends of the legs of the U-shaped bolt are secured to the cross-wire-side connection strip.

14. A wire-mesh fence comprising:

at least a first panel and a second panel, each panel comprising:

a first set of substantially parallel wires, each wire having a first and a second end, a picket-wire side, a cross-wire side, a second set of substantially parallel wires, the second set of wires being welded across the first set on the picket-wire side of the first set, a picket-wire side connection strip welded across the first end of the first set on the picket-wire side of the first set, and a cross-wire side connection strip welded across the second end of the first set on the cross-wire side of the first set;

the picket-wire side connection strip of the first panel being connected to the cross-wire side connection strip of the second panel; and the first set of substantially parallel wires of the first panel being substantially aligned with the first set of substantially parallel wires of the second panel.

15. A fence as in claim 14 further comprising one or more bolts having two ends, each end being inserted through one or more holes in the picket-wire side connection strip of the first panel and one or more holes in the cross-wire side connection strip of the second panel.

16. A fence as in claim 15, wherein each bolt end is threaded and further comprising a nut on each threaded end.

17. A fence as in claim 16 further comprising posts connected to the connection strips.

18. A fence as in claim 15, wherein the hole in at least one connection strip is slotted.

19. A fence as in claim 18, further includes at least one fastener located through the at least one through slot and the at least one through hole.

20. A fence as in claim 14, further comprising the cross-wire-side connection strip having at least one through slot and the picket-wire side connection strip comprising at least one through hole, wherein each picket-wire-side connection strip slot has a through hole that is aligned with a corresponding cross-wire-side connection strip slot.

* * * * *